US005419345A

United States Patent [19]

Kadymir

[11] Patent Number: 5,419,345

[45] Date of Patent: May 30, 1995

[54] HAIRPIECE

[76] Inventor: Jack Kadymir, 448 Neptune Ave., Brooklyn, N.Y. 11224

[21] Appl. No.: 231,790

[22] Filed: Apr. 25, 1994

[51] Int. Cl.[6] ..... A41G 5/00

[52] U.S. Cl. ..... 132/54; 132/53

[58] Field of Search ..... 132/53, 54

[56] References Cited

U.S. PATENT DOCUMENTS 4,168,713 9/1979 Asiotis ..... 132/53

FOREIGN PATENT DOCUMENTS 425241 5/1991 European Pat. Off. ..... 132/53

2504129 8/1976 Germany ..... 132/53

*Primary Examiner*—John G. Weiss

*Assistant Examiner*—Elise Speaks

[57] ABSTRACT

A centrally disposed hairpiece for a corresponding located central bald area of the user, in which cooperating outer "permanently" and removably inner components are attached along confronting edges characterized by interfitting elements, such as are typically used for a pivot hinge, by using as the equivalent of the hinge pin one of a flexuring construction material so that insertion therethrough is facilitated to position the inner component over the bald area when the user is in a public situation, and is readily withdrawn preparatory to removal of the inner component when conditions of privacy prevail.

1 Claim, 2 Drawing Sheets

FIG.1
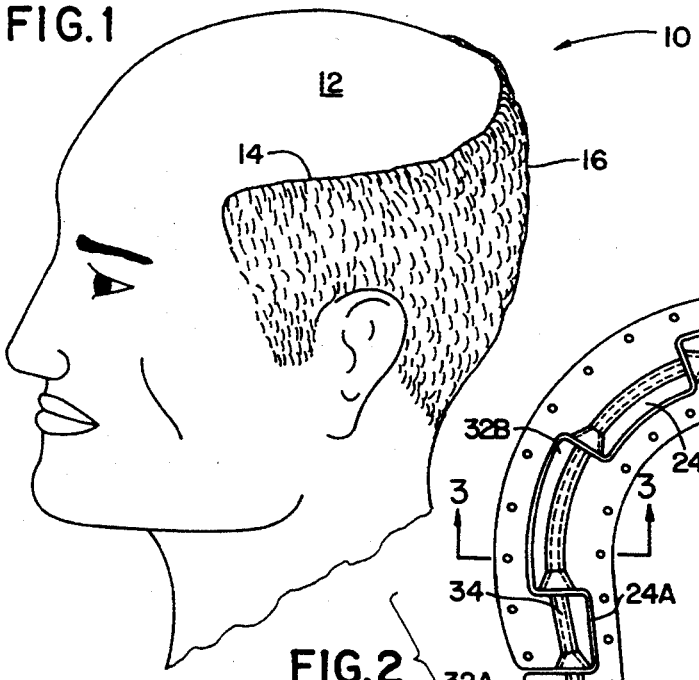
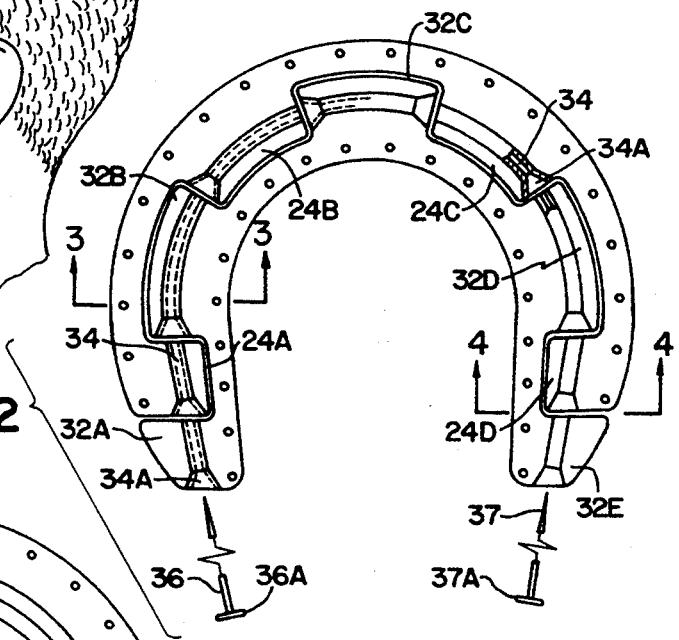
FIG.2
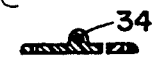
FIG.3
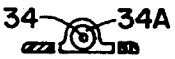
FIG.4
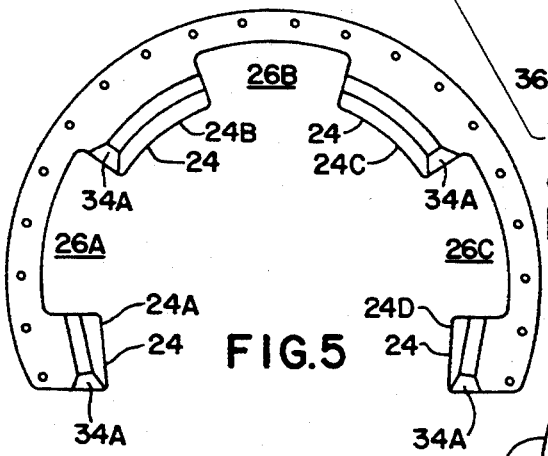
FIG.5
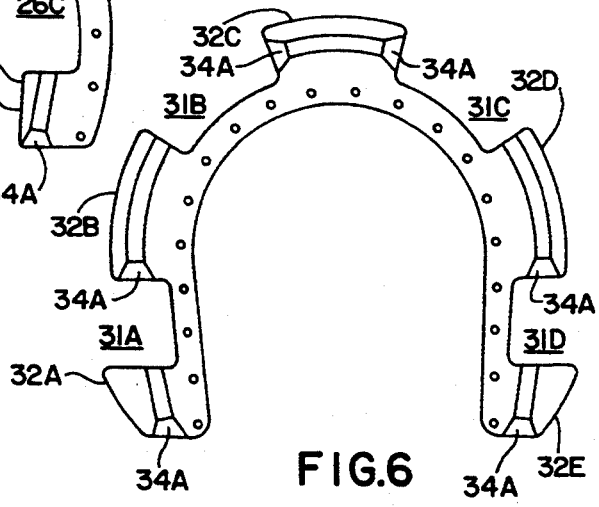
FIG.6

HAIRPIECE

The present invention relates to improvements for a hairpiece, the improvements more particularly contributing to the ease of attaching, with sufficient firmness to obviate inadvertent detachment, a bald area-covering hairpiece, and nevertheless permitting without any tedious procedure the ready detachment of the hairpiece preparatory to sleep, swimming or other occasions when removal contributes to comfort of the wearer without any attendant embarrassment.

Example of the Prior Art

As illustrated and described in U.S. Pat. No. 3,760,818 issued on Sep. 25, 1973 to Schweifer, an appearance-enhancing hairpiece is typically attached to natural fringe hair over a central bald area and contemplates the use of snaps or similar cooperating attaching devices to position the hairpiece for the purposes intended, and permit removal when it does not detract from privacy and the removal contributes to the comfort of the user. While snaps have some utility in providing for "detachable" attachment of the hairpiece, if the snaps have a firm friction fit of the male and female components to obviate inadvertent detachment, the intentional manual detachment is more difficult.

Broadly, it is an object of the present invention to provide a hairpiece overcoming the foregoing and other shortcomings of the prior art. More particularly, it is an object to achieve a secure attachment of an otherwise removable hairpiece in providing the operative position to such hairpiece, and yet enable the intentional removal of the hairpiece with comparative ease, all as will be readily understood from the detailed description which follows.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of a prospective user of the within inventive hairpiece;

FIG. 2 is a similar perspective view illustrating the two components of the hairpiece preparatory to their attachment to each other;

FIG. 3 is a sectional view taken along line 3—3 of FIG. 2;

FIG. 4 is another sectional view taken along line 4—4 of FIG. 2;

FIG. 5 is an isolated plan view of the outer hairpiece component of FIG. 2;

FIG. 6 is an isolated plan view of the inner hairpiece component of FIG. 2.

Figure 7:
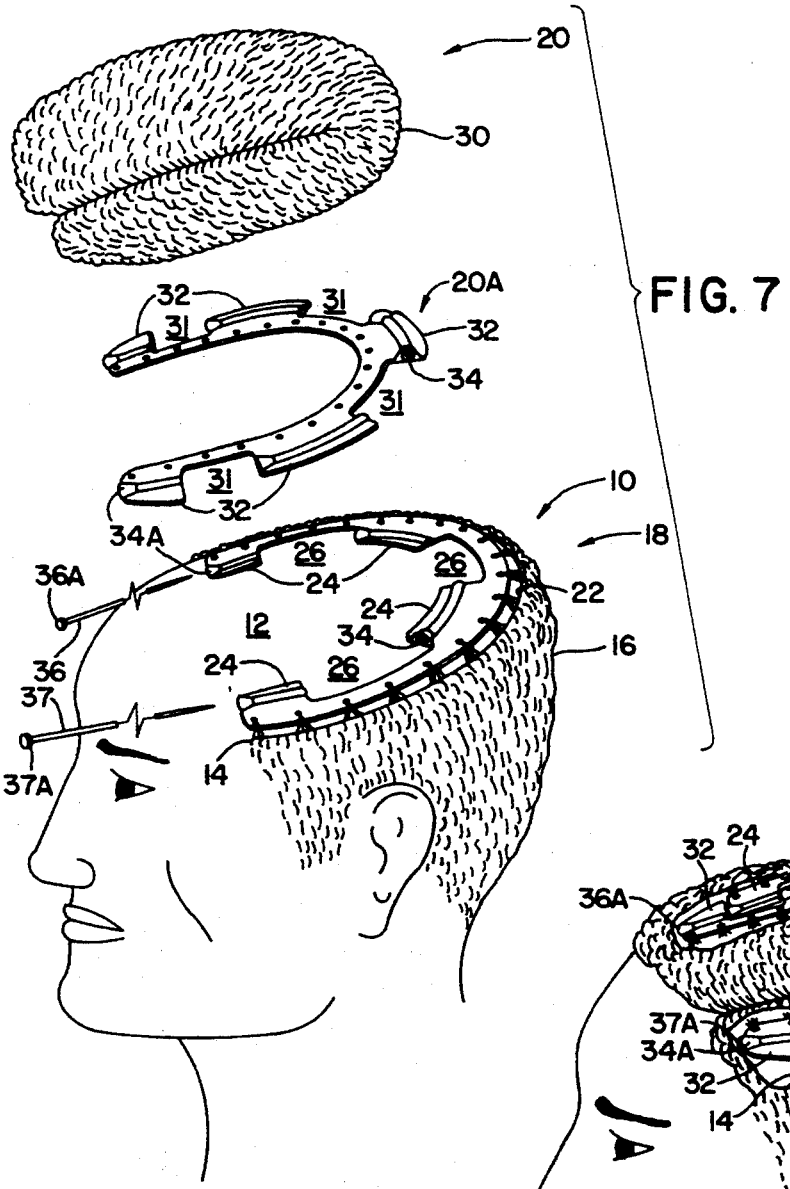
FIG. 7 is an exploded perspective view illustrating the within hairpiece in unassembled condition.

FIG. 1 illustrates a prospective male recipient 10 of the inventive hairpiece, soon to be described, to cover a centrally located bald area 12 typically encircled, from an edge 14 outwardly, by fringe natural hair 16. As best shown in FIG. 7, along edge 14 and attached in any appropriate manner to the fringe natural hair growth 16, as by use of an adhesive or braiding or otherwise, is a first component, generally designated 18. The attachment, for example, may be by braiding as described and illustrated in prior U.S. Pat. No. 4,372,330 issued on Feb. 8, 1983 to Nelson, and by this reference incorporated herein in its entirety, and contemplating a "permanent" or non-removable positioning of hairpiece component 18 to the natural hair 16 along the edge 14. That is, hair component 18 is not removable in preparation for sleep, exercising or other such occasions.

Rather, what is detachably attached to component 18 is a simulated hair growth 30 (FIG. 8) of the other hairpiece component 20, such detachment typically occurring prior to those occasions when removal is of a private nature and contributes to the comfort of the user 10, all as is well understood in the use of hairpieces. In this regard, it is the ease of attachment and detachment of the hairpiece 20 in relation to hairpiece 18 which underlies the present invention.

Hairpiece 18 is thus provided with an inner edge in encircling and facing relation to the bald area 12 along which there are appropriately positioned spaced hinge-like hollow segments, individually and collectively designated 24, the spaces 26 therebetween being of a selected size. On the underside of hairpiece 20, is an outer edge of simulated hair growth 30 having an operative position when hairpiece 20 is placed in covering relation over the bald area 12 in facing relation to the other hairpiece component 18. Along said confronting edge of the simulated hair 30 and, more particularly, supported on the component 20 are cooperating similar hinge-like hollow segments 32, each sized to fit in the spaces 26 and being alternately spaced with respect to the other segments 24 so that the segments 24 and 32 are alternately arranged and together define a continuous passageway 34 bounded by the circular wall which bounds the hollow center of the respective segments 24 and 32.

As shown in cross section as taken along lines 3—3 and 4—4 of FIG. 2 in conjunction with the plan view of 2, the segments 24 and 32 are identically constructed to provide said continuous passageway 34 through which pins 36 and 37 are projected from opposite directions through a pivotal traverse of 180 degrees each, as will soon be described, each length of the passageway 34 having a flared opening 34A to facilitate the projection therein of the pins 36 and 37.

Figure 8:
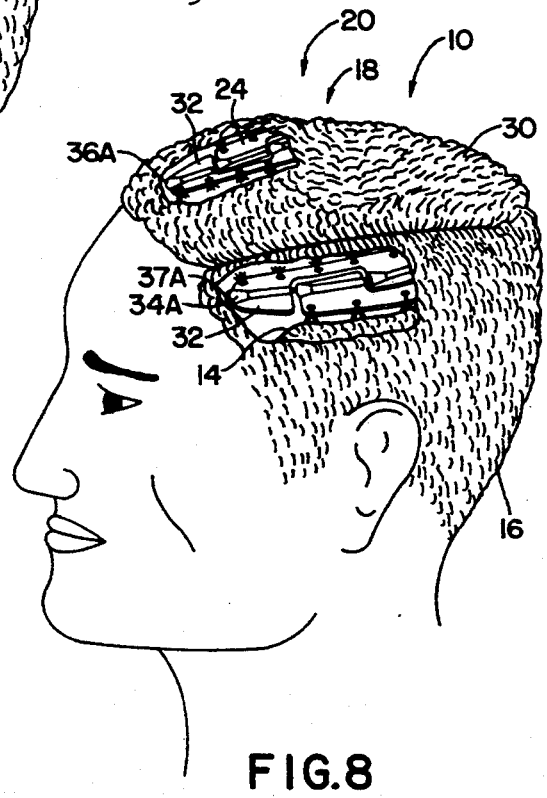
FIG. 8 is a perspective view of the hairpiece in assembled condition.

As may be readily understood from FIG. 2, as well as the other FIGS. 7 and 8, after providing the operative condition of the alternately arranged segments 24 and 32, two pins 36 and 37, each of flexible construction material, are inserted from opposite directions into and then progressively urged through movement along the passageway 34 and, as a consequence, each pin assumes a semicircular shape tracking the edge 14. Even more important, the pins 36 and 37 as best shown in FIG. 8 cooperate to complete the connection of hairpiece 20 with its supplementing hair growth 30 to hairpiece 18 and inadvertent, and possible attendant embarrassment, is obviated by the outward urgency of the angularly flexed pins 36 and 37 in the passageway 34. Yet, intentional detachment of hairpiece 20 from hairpiece 18 is readily achieved by manual removal of pins 36 and 37 by merely pulling on the end finger grip 36A, 37A provided for the convenience of the user 10 for this purpose.

In a preferred embodiment, the hairpiece components 18 and 20 are of plastic construction material and typically would be sized and configurated as will now be described.

Hairpiece component 18, as shown in the isolated plan view of FIG. 5, will be understood in a preferred embodiment to be approximately 8¼ inches in circumferential length and is embodied with four segments previously generally designated 24 wherein, more particularly, in a clockwise direction, the first encountered segment 24A is approximately 5/8 inch in length, followed by a space 26A of 1-1/8 inches, a second encountered segment 24B of approximately 1-1/8 inches in length, a second encountered space 26B of 1-3/8 inches, a third encountered segment 24C, space 26C and final segment 24D respectively 1-1/8 inches, 1-3/8 inches and 5/8 inch, i.e. duplicating the size dimensions of 24A, 26A and 24B of the initial 180 degree traverse of the flexible pin 36.

Hairpiece component 20, as shown in the isolated perspective view of FIG. 6, will be understood in a preferred embodiment to be approximately 7 inches in circumferential length and is embodied with five segments in a radially outward orientation to align in an alternate arrangement with the segments 24. In a clockwise direction, the first encountered segment 32A is approximately 5/8 inch in length, followed by a first encountered space 31A of slightly more than 5/8 inch, so as to accommodate segment 24A, a second encountered segment 32B of approximately 1 inch to fit in the slightly oversized space 26A, a second encountered space 31B of approximately 1¼ inches to receive therein segment 24B, a third encountered segment 32C of approximately 1-5/8 inches, and next encountered space 31C, segment 32D, space 31D and final segment 32E, respectively 1¼ inches, 1 inch, 5/8 plus inches, and 5/8 inch, i.e. duplicating the size dimensions of 32A, 31A, 32B and 31B of the initial 180 degree traverse of the flexible pin 36.

In the placement of wig 20A over the bald area 12 it is contemplated that the user will grip with his left and right hands the respective segments 32A and 32E and determine, by touch, the fronts of segments 24A and 24D and place said segments 32A and 24A, and said segments 32E and 24D in alignment with each other. In achieving this alignment, the user merely then eases wig 20A over the bald area 12 and this will result in segment 32B seating in space 26A, segment 32C seating in space 26B, and segment 32D seating in space 26C. With said segments 32A–E and 24A–D in alignment with each other, the pins 36 and 37 are then inserted from opposite directions through the opposite ends of the passageway 34 and, being of flexible construction material, the pins 36 and 37 are progressively urged into semi-circular flexed configurations which completes the connection of wig 20A of hairpiece 20 to the hairpiece 18. To detach the hairpieces, the pins 36 and 37 are manually removed.

In a preferred embodiment, component 20 is stitched, adhesively or otherwise appropriately attached to the wig hair component 30, so that when component 30 exhibits a worn appearance a replacement hair component 30 can be used with the same component 20.

While the hairpiece herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A hairpiece attachment device for attaching a hairpiece to a central scalp bald area of a user's head, said device comprising:

a first component attachable to said central scalp bald area, said first component having an inner edge and a first plurality of hinge-type hollow cylindrical segments spaced along said inner edge;

a second component on which a hairpiece is attachable, said second component having an outer edge and a second plurality of hinge-type hollow cylindrical segments spaced along said outer edge;

said first and second pluralities of hinge-type segments aligned to interfit with one another to form a continuous passageway through said segments;

two flexible pins, each said pin insertable through an opposite end of the passageway of said hinge-type segments, thereby attaching said first component to said second component such that insertion and withdrawal of said pins from said passageway renders the hairpiece removably attachable to the head as a cover for said central scalp bald area.

* * * * *